US007263729B2

(12) United States Patent
Paesang et al.

(10) Patent No.: US 7,263,729 B2
(45) Date of Patent: Sep. 4, 2007

(54) PLAYYARD WITH CHANGING PLATFORM AND BASSINET

(75) Inventors: Chinawut Paul Paesang, Cumberland, RI (US); Geoff Swales, Somerset, MA (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 11/294,480

(22) Filed: Dec. 6, 2005

(65) Prior Publication Data

US 2006/0253980 A1 Nov. 16, 2006

Related U.S. Application Data

(63) Continuation of application No. 11/125,771, filed on May 10, 2005, now abandoned.

(51) Int. Cl.
*A47C 7/00* (2006.01)
*A47D 13/06* (2006.01)

(52) U.S. Cl. ..... 5/98.1; 5/93.1

(58) Field of Classification Search ..... 5/93.1, 5/98.1, 93.2, 99.1, 102
See application file for complete search history.

(56) References Cited

U.S. PATENT DOCUMENTS 3,311,934 A * 4/1967 Goldberg ..... 5/102
5,339,470 A 8/1994 Shamie
5,553,336 A * 9/1996 Mariol ..... 5/93.1
5,778,465 A * 7/1998 Myers ..... 5/99.1
5,867,850 A 2/1999 Mariol
5,918,329 A 7/1999 Huang
6,173,462 B1 * 1/2001 Huang et al. ..... 5/655
6,182,308 B1 * 2/2001 Yang ..... 5/93.1
6,192,535 B1 * 2/2001 Warner et al. ..... 5/93.1
6,233,759 B1 * 5/2001 Warner et al. ..... 5/99.1
6,418,575 B1 * 7/2002 Cheng ..... 5/93.1
6,430,762 B1 * 8/2002 Cheng ..... 5/93.2
6,434,767 B1 * 8/2002 Welsh, Jr. ..... 5/93.2
6,526,608 B1 * 3/2003 Hsia ..... 5/99.1
6,539,563 B1 * 4/2003 Hsia ..... 5/93.2
6,543,070 B2 * 4/2003 Longenecker et al. ..... 5/93.1
6,634,038 B2 * 10/2003 Hsia ..... 5/95
6,735,796 B2 5/2004 Warner, Jr. et al.
D500,213 S 12/2004 DeHart et al.
6,895,611 B2 * 5/2005 Tharalson et al. ..... 5/99.1
6,901,613 B1 * 6/2005 Hsia ..... 5/93.1
6,907,626 B1 * 6/2005 Welsh et al. ..... 5/99.1
6,948,197 B1 * 9/2005 Chen ..... 5/93.1
7,003,821 B2 * 2/2006 DeHart et al. ..... 5/93.1
7,013,505 B2 * 3/2006 Martin ..... 5/95
7,043,779 B2 * 5/2006 Mendenhall et al. ..... 5/99.1
7,055,191 B1 * 6/2006 Chen ..... 5/93.2
2002/0166169 A1 * 11/2002 Longenecker et al. ..... 5/93.1

* cited by examiner

*Primary Examiner*—Patricia Engle
*Assistant Examiner*—Jonathan Liu
(74) *Attorney, Agent, or Firm*—Barnes & Thornburg LLP

(57) ABSTRACT

A juvenile playyard including an infant care assembly having a fabric bassinet and changing platform mountable across a portion of a top opening of the playyard.

23 Claims, 9 Drawing Sheets

PLAYYARD WITH CHANGING PLATFORM AND BASSINET

CROSS-REFERENCE

This is a continuation application of U.S. application Ser. No. 11/125,771, filed on May 10, 2005 now abandoned, which disclosure is incorporated herein by reference.

BACKGROUND

The present disclosure relates to juvenile playyards and particularly to playyards with changing tables and bassinets. More particularly, the present disclosure relates to an infant care assembly including a changing platform and bassinet mounted across a portion of a top opening of a playyard.

SUMMARY

According to the present disclosure, a playyard includes a frame having two side rails and two end rails that cooperate to form a top opening of the playyard. Also included is a fabric frame cover overlying the frame. The playyard further includes an infant care assembly that has a cross-bar mountable on the frame in a position spanning across the top opening of the playyard at substantially a midpoint of the two side rails.

The infant care assembly includes a fabric bassinet coupled to the cross-bar and removably couplable in a use position to the fabric frame cover and also includes a changing platform coupled to and rotatable about the cross-bar.

The playyard further includes a coupling mechanism configured to couple the changing platform to the frame in a use position overlying the fabric bassinet when the fabric bassinet is coupled in the use position.

Other aspects of the present disclosure will become apparent from the following descriptions when considered in conjunction with the accompanying drawings.

BRIEF DESCRIPTION OF THE DRAWINGS

The detailed description particularly refers to the accompanying figures in which.

DETAILED DESCRIPTION

Generally, the present disclosure relates to an infant care assembly removably mountable on a playyard frame across a top opening of the playyard at essentially a mid-point of two-spaced apart side rails of the playyard. The infant care assembly includes a fabric bassinet that is couplable in a use position across a portion of the top opening to portions of a fabric frame cover overlying the two-spaced apart side rails and one of two spaced-apart end rails. The coupling of the fabric bassinet to the fabric frame cover is configured such that the fabric bassinet is essentially maintained in the use position when an upward or downward force is exerted on the fabric bassinet from within the top opening, thereby preventing an undesired uncoupling of the fabric bassinet from the fabric frame cover. The infant care assembly also includes a changing platform configured to be couplable in a use position only to the same end rail as the fabric bassinet when the fabric bassinet is coupled in its use position across the top opening. The changing platform, when coupled in its use position, extends across essentially the same portion of the top opening as the fabric bassinet and essentially overlies and covers access to the fabric bassinet.

Figures 1A, 1B:
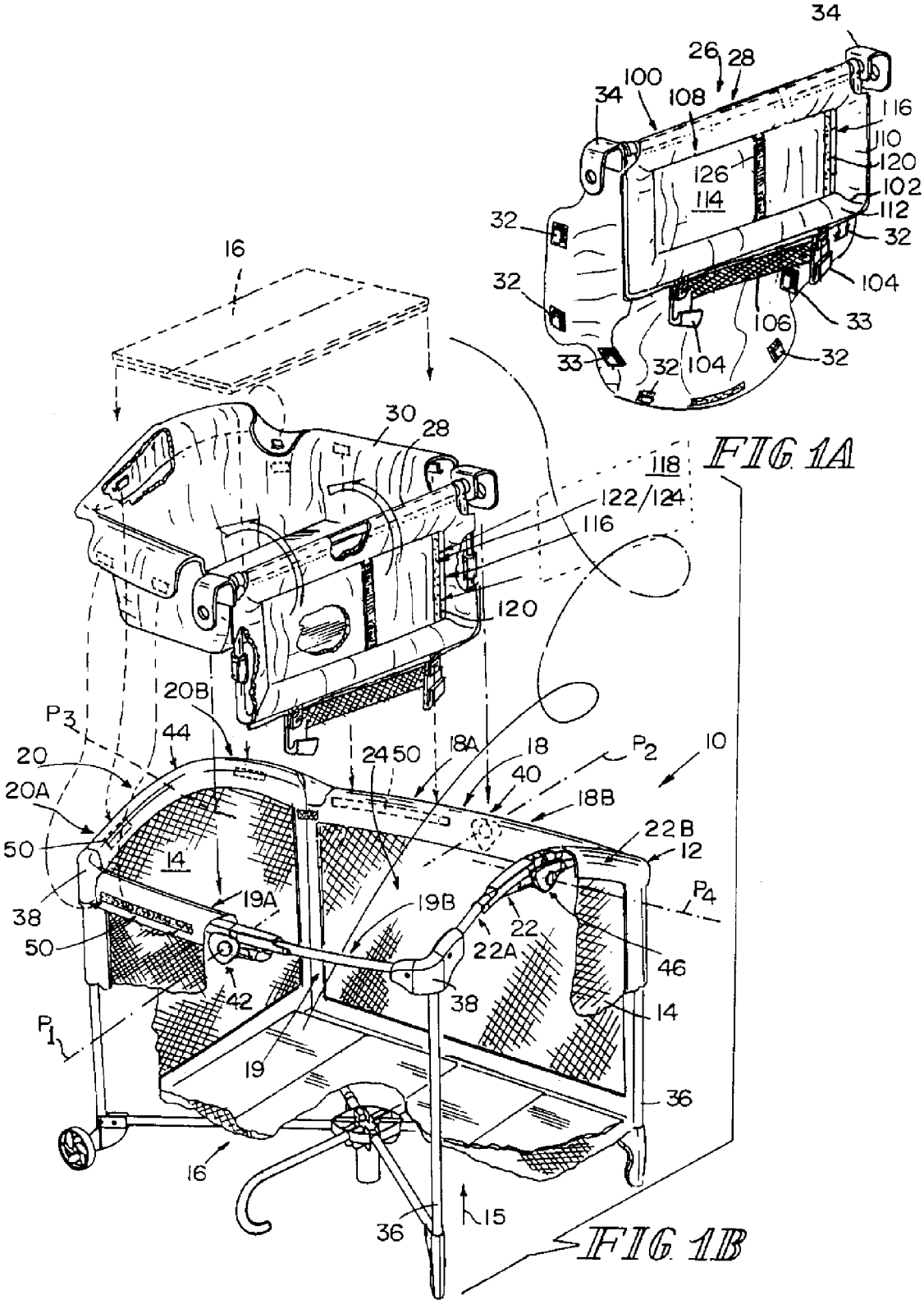
FIG. 1A is a perspective view of an infant care assembly, in accordance with the present disclosure, showing a fabric-covered infant changing platform and a fabric bassinet coupled to a cross-bar, the cross-bar including frame connectors configured to be mountable on a frame of a playyard, the fabric bassinet shown having the fabric in a substantially unstructured state hanging downwardly from the cross-bar and including bassinet connectors configured to be couplable to a fabric frame cover on the frame, and the infant changing platform being rotatably coupled to the cross-bar and including rail connectors configured to be coupled to an end rail of the playyard.
FIG. 1B is an exploded, perspective view of a playyard, with portions broken away, in accordance with the present disclosure showing a playyard frame, a fabric frame cover, and the infant care assembly of FIG. 1A shown here substantially as it would be configured in a substantially structured state after installation of the fabric bassinet across a top opening of the playyard, and the infant changing platform shown in a non-use or stored position hanging downwardly toward the floor of the playyard and configured to be rotatable about the cross-bar into a use position overlying the installed fabric bassinet, as suggested by the arrows.
Figure 2A:
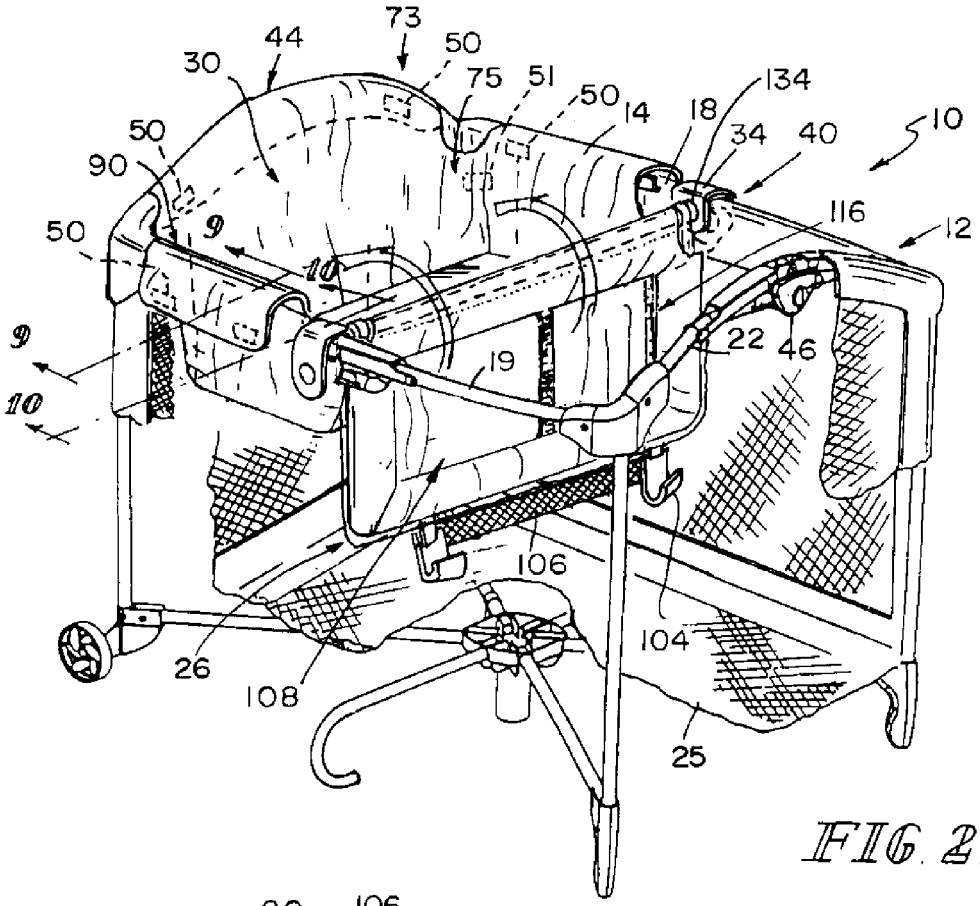
FIG. 2A is a perspective view of the playyard of FIG. 1B, with portions broken away, showing the infant care assembly mounted on the playyard, the fabric bassinet being installed in a use position coupled to the fabric frame cover and the infant changing platform being in the non-use or stored position.
Figure 2B:
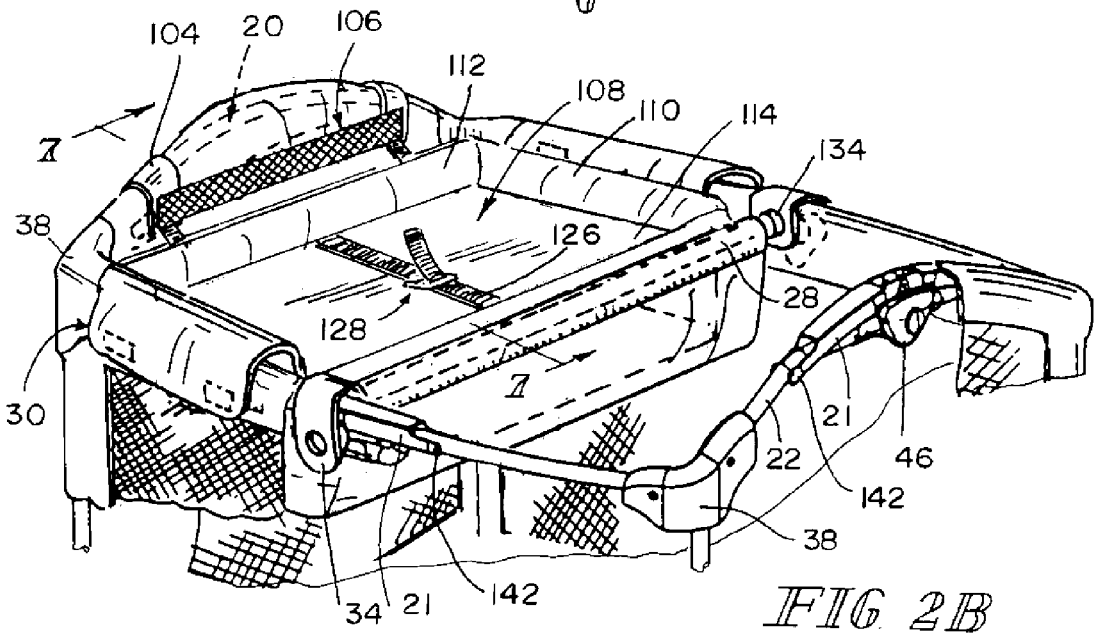
FIG. 2B is a perspective view of the playyard of FIG. 2A, with portions broken away, showing the infant changing platform in a use position overlying the installed fabric bassinet, the infant changing platform including rail connectors coupled to the end rail of the playyard frame.

More specifically, as shown in FIGS. 1A and 1B, playyard 10 includes a collapsible frame 12, fabric frame cover 14 and removable floor mat 16. Frame 12 includes two spaced-apart side rails 18, 19 and spaced-apart first and second end rails 20, 22, all cooperating to form a top opening 24 of the playyard 10. Playyard 10 also includes an infant care assembly 26 including a cross-bar 28, a fabric bassinet 30 and a changing platform 100. Fabric bassinet 30 is shown in FIG. 1A in a substantially unstructured state coupled to and hanging downwardly from cross-bar 28. Fabric bassinet 30 includes bassinet connectors 32 and fabric connectors 33 configured to couple the fabric bassinet 30 to fabric frame cover 14. Cross-bar 28 includes frame connectors 34, shown, for example, as J-shaped clips, configured to be mountable on collapsible frame 12, at substantially a mid-point of side rails 18, 19, as suggested in FIG. 1B. Fabric bassinet 30 is shown, for example, in a substantially structured state in FIG. 1B as it would appear when bassinet assembly 26 and fabric bassinet 30 are coupled to collapsible frame 12 and installed in a use position in playyard 10, as shown in FIG. 2A.

Changing platform 100 is shown in FIGS. 1A-2A pivotably coupled to cross-bar 28 and is shown hanging downwardly in a non-use or stored position. Changing platform 100 includes a frame 130 covered by fabric covering 102 (see FIG. 5A). Changing platform 100 also includes rail connectors 104 configured to couple to receiving areas 138 on, for example, first end rail 20, as suggested in FIG. 5A. Changing platform 100 may also include a recessed area 108 defined by a pair of opposed, angled end segments 110, a pair of opposed angled side segments 112 and a bottom portion 114 (see also FIG. 2B). The bottom portion 114 includes an opening 116 configured to removably receive a support board 118 to provide a stable platform for placing an infant (not shown). The support board 118 is held in place inside the bottom portion 114 by a flap 120 removably secured by, for example, hook 122 and loop 124 material on the flap 120 and fabric covering 102, respectively. The changing platform 100 also includes a restraining strap 126 and buckle 128 wrapped around the bottom portion 114 and configured to be used to secure the infant (not shown) in the recess 108 of the changing platform 100 when the changing platform 100 is in a use position, as shown in FIG. 2B.

Rail connectors 104 are connected to fabric webbing 106 which is attached to fabric covering 102. Fabric webbing 106 is connected and configured such that it essentially prevents a twisting of rail connectors 104.

The structure of playyard 10 is similar in many respects to the playyard disclosed in U.S. patent application Ser. No. 10/353,378, filed Jan. 29, 2003 and in a co-pending application by Applicants filed on even date and titled "Playyard With Bassinet". The similarities and differences among and between these applications will be apparent as the present disclosure unfolds below.

As suggested in FIGS. 1A-2B, collapsible frame 12 includes four corner legs 36 and a corner piece 38 at the top end of each corner leg 36. Side rails 18, 19 and first and second end rails 20, 22 are interconnected by corner pieces 38. Each side rail 18, 19 includes a first segment 18A, 19A, respectively, coupled to a second segment 18B, 19B, respectively, for pivotable movement about pivot axis $P_1$ and $P_2$, respectively, on side rail locking mechanisms 40, 42, respectively. First end rail 20 includes a first segment 20A coupled to second segment 20B for pivotal movement about pivot axis $P_3$ on first end rail locking mechanism 44, and second end rail 22 includes a first segment 22A coupled to second segment 22B for pivotal movement about pivot axis $P_4$ on second end rail locking mechanism 46. Each rail locking mechanism 40, 42, 44, 46 is located at substantially a mid-point of each respective rail 18, 19, 20, 22 and includes an actuator 48 for disengaging each respective locking mechanism 40, 42, 44, 46 to permit the playyard to be placed in a collapsed configuration (not shown). Actuator 48 is shown, for example, as a button-like element or protrusion extending outwardly from each rail locking mechanism 40, 42, 44, 46.

Figure 10:
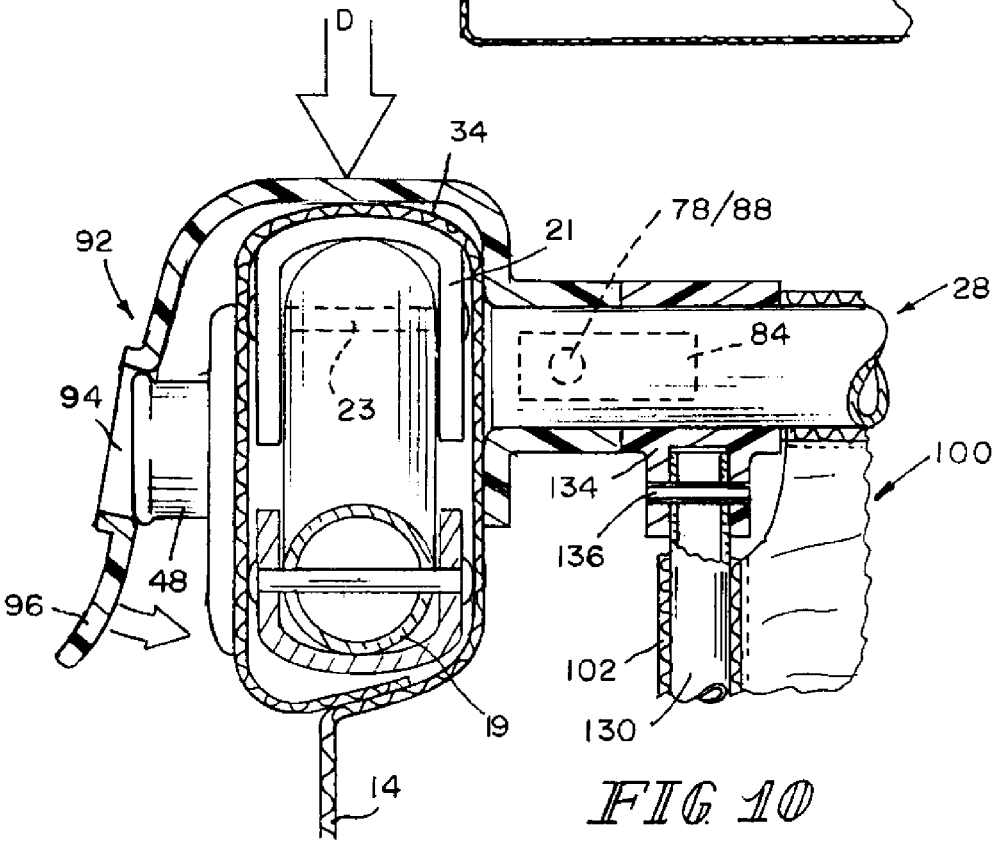
FIG. 10 is a sectional view taken along line 10-10 of FIG. 2A, showing a frame connector on the cross-bar being coupled to a receiver element on a side rail locking mechanism of the playyard, and further showing a ring connector of the infant changing support frame coupling the infant changing platform to the cross-bar.
Figure 11:
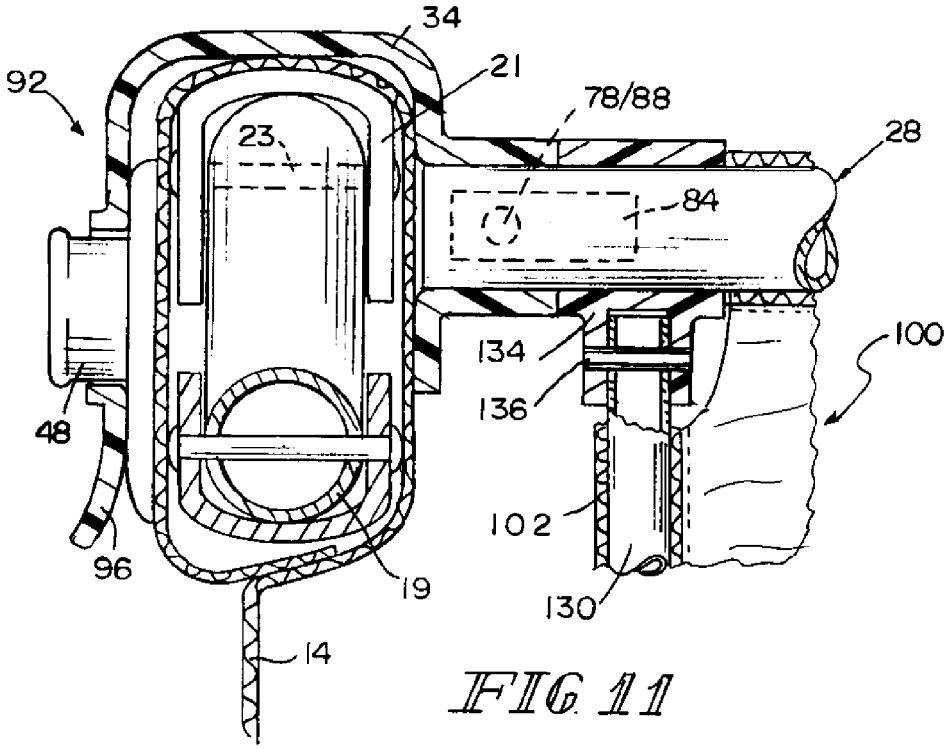
FIG. 11 is a sectional view, similar to FIG. 10, showing the frame connector coupled to the receiver element on the side rail locking mechanism of the playyard.
Figure 12:
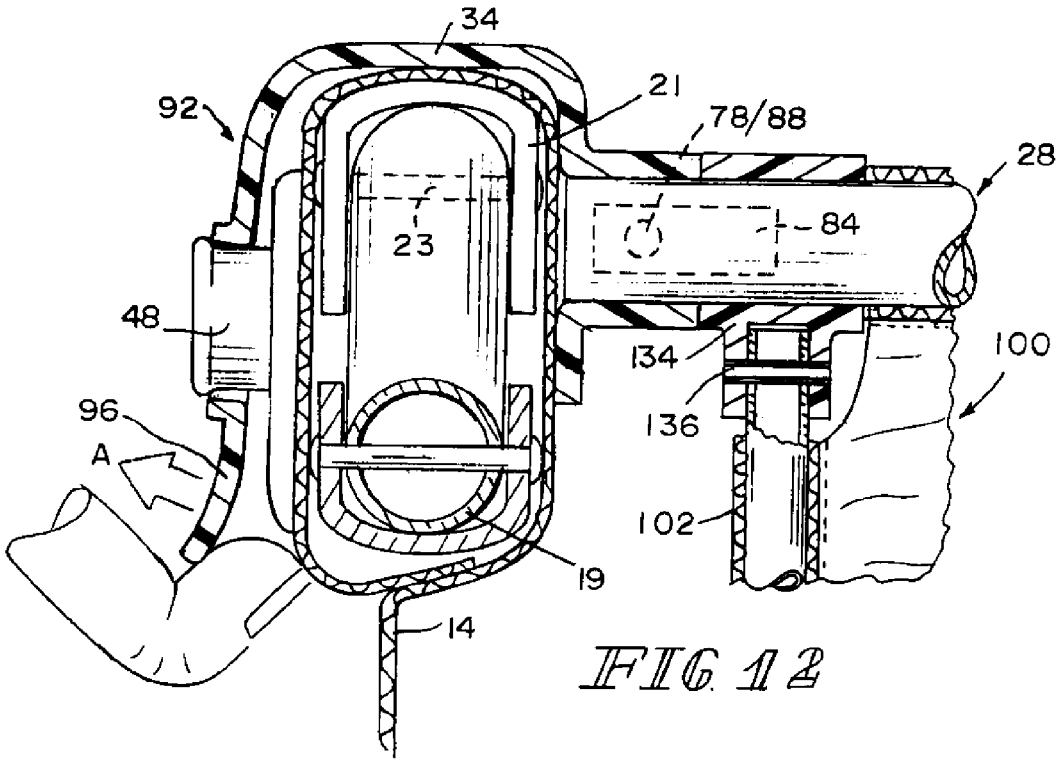
FIG. 12 is a sectional view, similar to FIG. 11, showing a person's finger applying a force to an interior surface of a free end or lip of the frame connector to uncouple the frame connector from the receiver element, thereby uncoupling the infant care assembly from the frame.

As suggested in FIGS. 1B-2B and as shown, for example, in FIGS. 10-12, collapsible frame 12 also includes rail extenders 21 pivotably connected by pins 23 to each rail segment 18A, 18B, 19A, 19B, 20A, 20B, 22A, 22B and configured to overlie portions of each rail segment 18A, 18B, 19A, 19B, 20A, 20B, 22A, 22B, and portions of each rail locking mechanism 40, 42, 44, 46, thereby creating a relatively smooth and essentially continuous surface between each pair of respective pivotably connected rail segments.

Fabric frame cover 14 overlies collapsible frame 12 and is made of a sturdy fabric and netting material that is foldable to enable collapsible frame 12 to be moved from an erected position, as shown in FIG. 1B, to a collapsed position (not shown). Fabric frame cover 14 includes a plurality of receivers 50, 51 attached or connected on an outer or exterior surface 52 of portions of the fabric frame cover 14 that overlie portions of side rails 18, 19 and one of end rails 20, 22, and shown in FIGS. 1B and 2A as first end rail 20. One of the receivers 50 is best seen, for example, in FIG. 3A. Receiver 50 is configured as a loop 54 created by an opening 56 between a portion of strap 58 and fabric frame cover 14. Strap 58 is shown attached to fabric frame cover 14 by, for example, sewing. One of the receivers 51 is best seen in FIG. 3B. Receiver 51 is also configured as a loop 55 created by an opening 57 between a portion of strap 59 and fabric frame cover 14. It is within the scope of the present disclosure that straps 58 and 59 may be attached to fabric frame cover 14 by other means than sewing and that loops 54 and 55 and/or openings 56 and 57 may be created on fabric frame cover 14 by other configurations. Fabric frame cover 14 also includes one part of a securing mechanism 60, such as hook-type material 62, configured to cooperate with another part of securing mechanism 60, such as loop-type material 64 on fabric bassinet 30, to removably secure fabric frame cover 14 to fabric bassinet 30 at first end rail 20, as suggested, for example, in FIG. 4.

Infant care assembly 26 includes cross-bar 28, and fabric bassinet 30 and changing platform 100 connected to the cross-bar 28. Fabric bassinet 30 includes a plurality of bassinet connectors 32 and 33 shown in FIGS. 3A and 3B, for example, as U-shaped clips that are attached to the fabric bassinet 30. Bassinet connectors 32 are attached and oriented such that they are couplable in an upward direction toward top opening 24 to the loops 54 on the fabric frame cover 14, as suggested in FIG. 3A. Fabric connectors 33 are attached and oriented such that they are couplable in a downward direction toward floor 25 of the playyard 10 to loops 55 adjacent corner pieces 38, as suggested in FIG. 3B and shown in FIG. 3C.

Figure 3A:
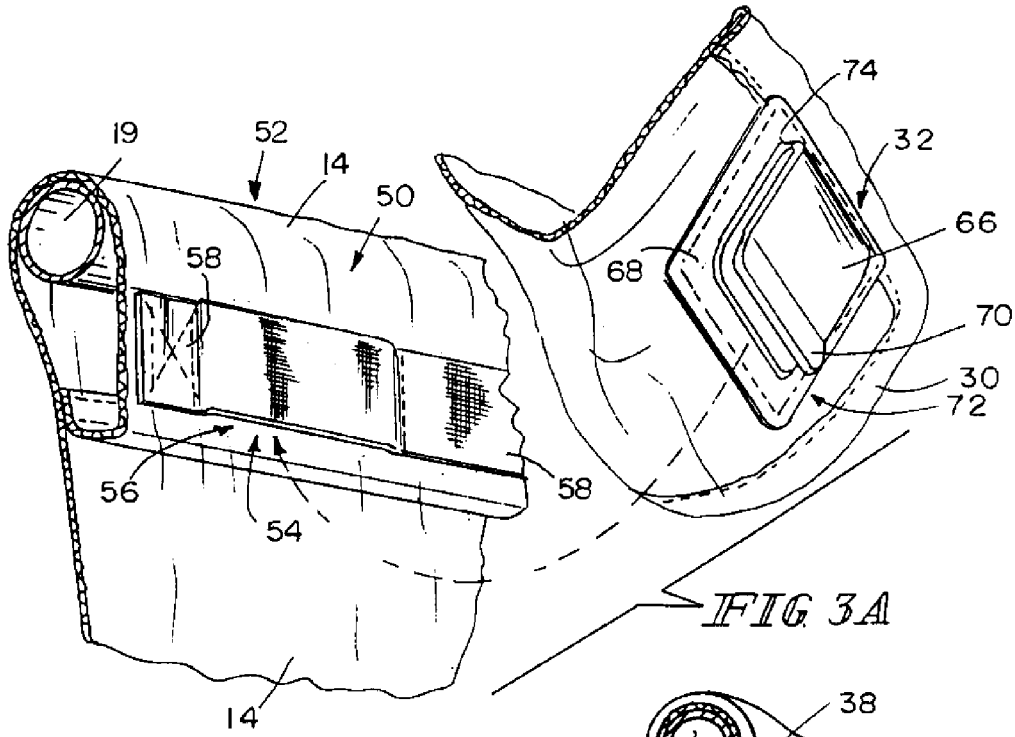
FIG. 3A is an enlarged, exploded perspective view, with portions broken away, showing one of the bassinet connectors of FIG. 1A on the fabric bassinet and configured to be couplable in an upward direction (as suggested by the arrow) to a receiver on the fabric frame cover.
Figure 3C:
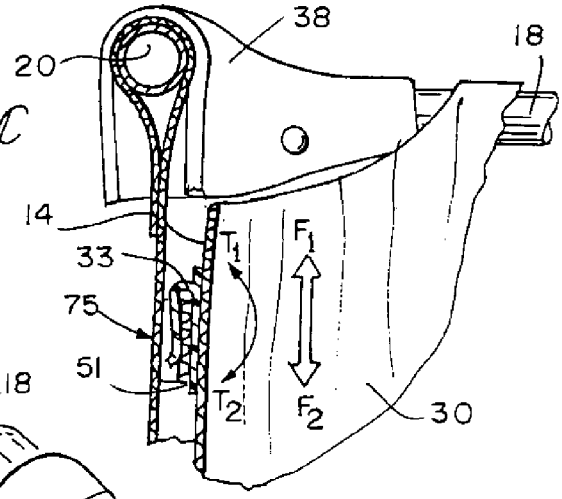
FIG. 3C is a sectional view taken along line 3C-3C of FIG. 3B, showing one of the fabric connectors coupled to one of the receivers on the fabric frame cover and forming a coupling.
Figure 3B:
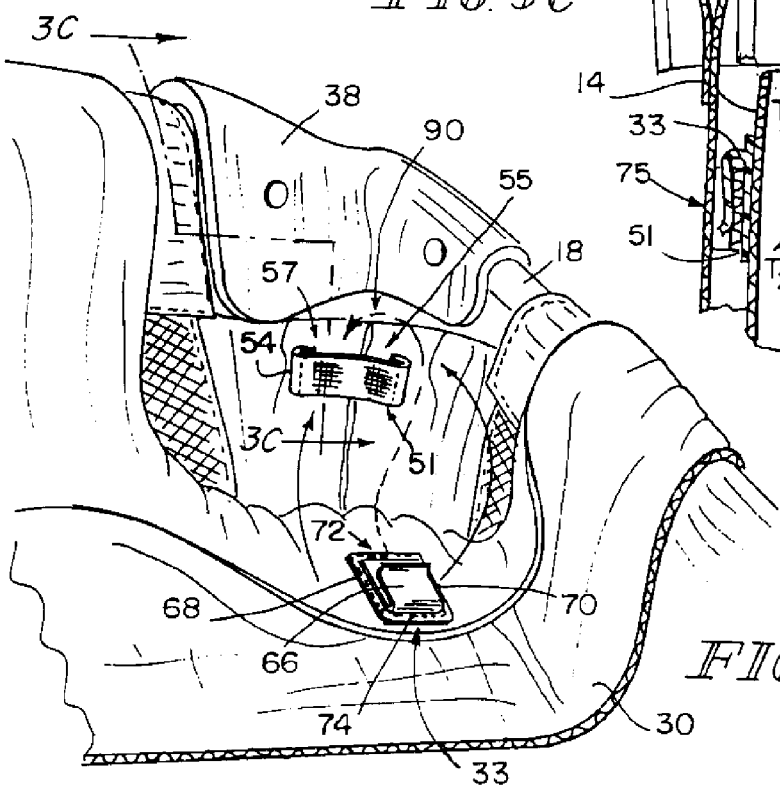
FIG. 3B is an enlarged, exploded perspective view, with portions broken away, showing one of the fabric connectors of FIG. 1A on the fabric bassinet and configured to be couplable in a downward direction (as suggested by the arrow) to a receiver on the fabric frame cover.
Figure 4:
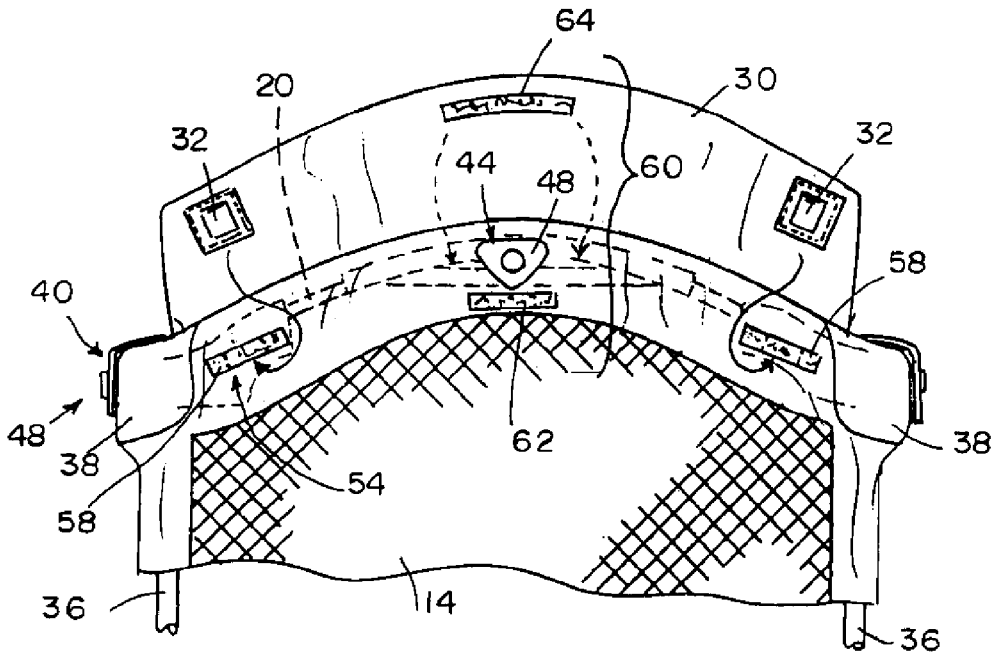
FIG. 4 is an end view of the playyard of FIG. 2B, with portions broken away, showing an end portion of the fabric bassinet configured to be draped over an end rail of the playyard, the end portion including bassinet connectors configured to be couplable in an upward direction to receivers on the fabric frame cover.
Figure 9:
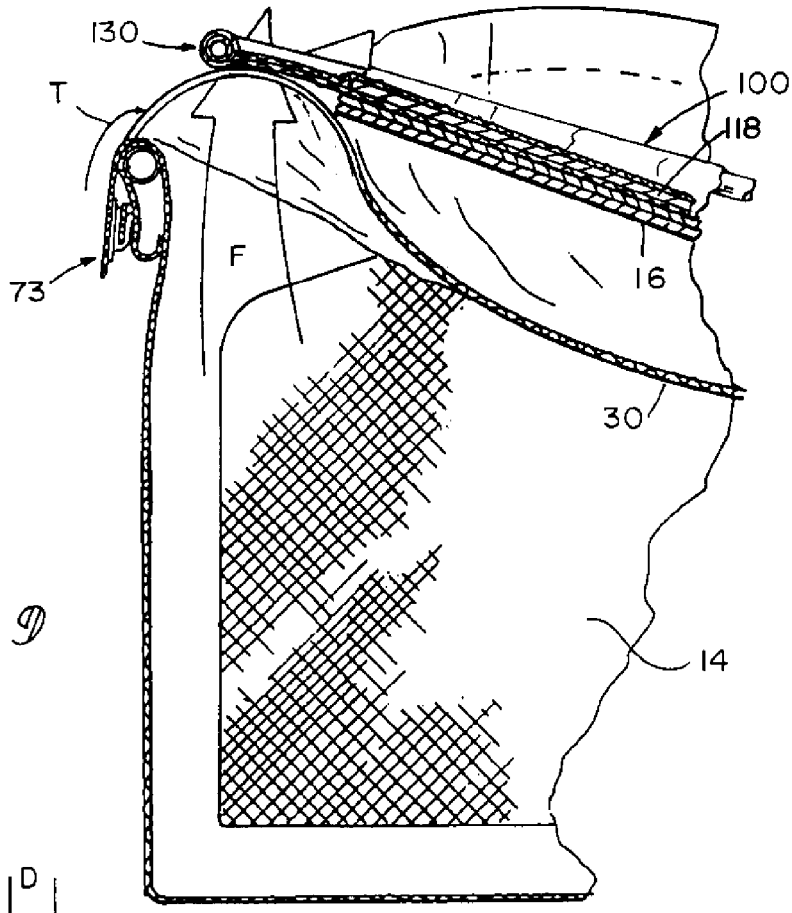
FIG. 9 is a sectional view taken along line 9-9 of FIG. 2B, with portions broken away, showing a coupling of a bassinet connector on the fabric bassinet to a receiver on the fabric frame cover, and further showing that an upward force on the fabric basinet from within the top opening of the playyard results in a tensioning of the coupling of the bassinet connector to the receiver, as suggested by the tension T and force F arrows.

Each U-shaped clip 32 includes legs 66 and 68 and a lip 70 angled and extending outwardly away from leg 68 and opening 72 between legs 66 and 68 so as to facilitate the forming of a coupling 73 of clip 32 and loop 54, as suggested in FIG. 3A and as seen, for example, in FIG. 9. Clip 32 is shown in FIG. 3A as being connected to a semi-rigid backing material 74 that is attached to fabric bassinet 30 by, for example, sewing and providing support for clip 32.

Each U-shaped clip 33 is configured similarly to clip 32 but, as noted above, is oriented to facilitate the forming of a coupling 75 (see FIGS. 3B and 3C) that assists in minimizing the size of a potential gap 90 that may form between fabric bassinet 30 and frame 12 adjacent corner pieces 38 at each end of first end rail 20, as suggested in FIGS. 2A and 3B. It is within the scope of the present disclosure that clips 32, 33 and receivers 50, 51 may include different configurations cooperating to form couplings 73, 75, respectively.

Figure 5A:
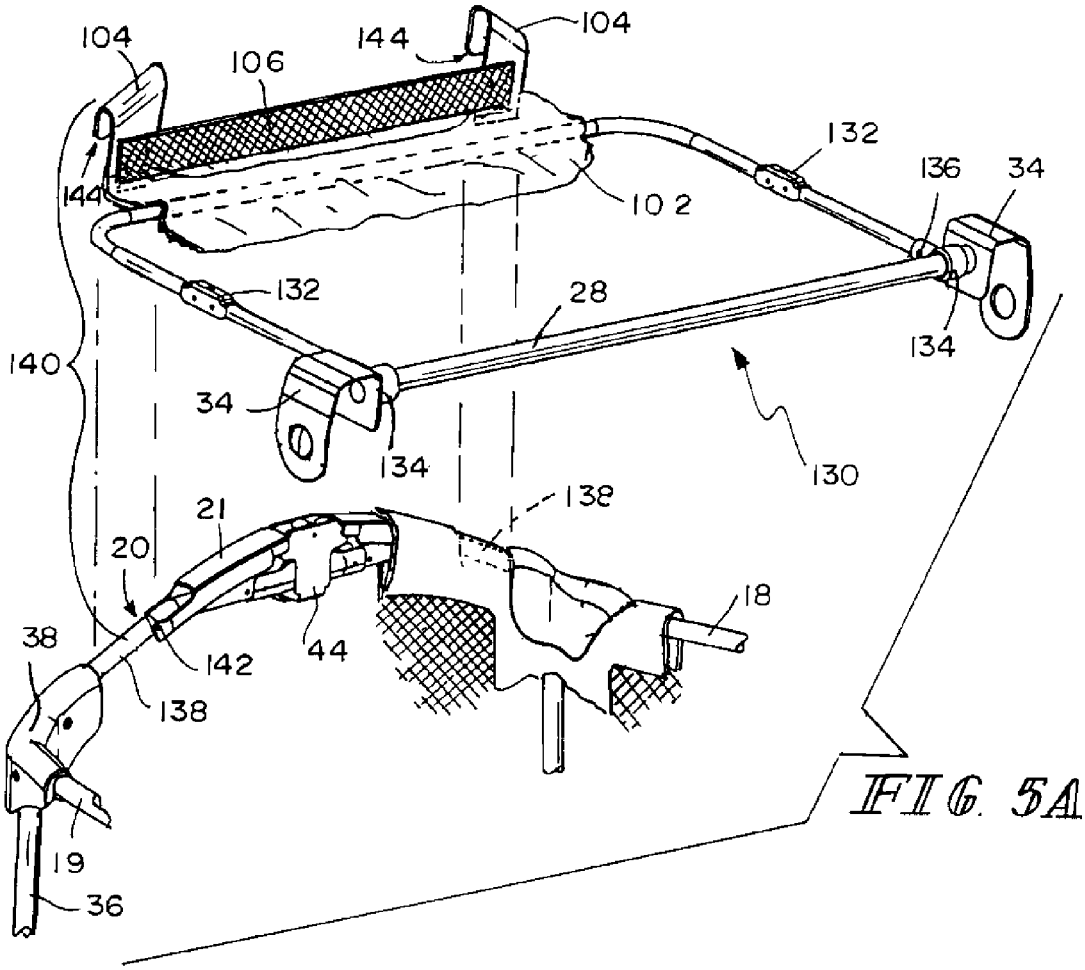
FIG. 5A is a perspective view of a support frame of the infant changing platform and portions of the playyard frame, in accordance with the present disclosure, showing rail connectors coupled to fabric on the infant changing platform and configured to be coupled to receiving areas underlying the fabric frame cover on an end rail of the playyard frame.
Figure 5B:
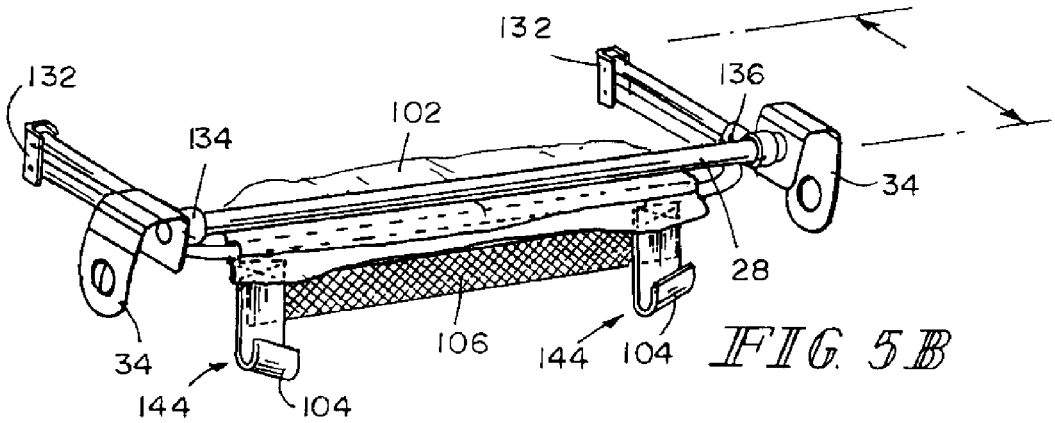
FIG. 5B is a perspective view of the support frame of FIG. 5A, with portions of fabric broken away, showing hinges on the support frame and further showing the support frame rotated about the hinges into a folded condition.

As noted above, changing platform 100 includes support frame 130 covered by fabric covering 102, as suggested in FIG. 5A. Support frame 130 includes hinges 132 configured to allow support frame 130 to fold into a folded position, as shown in FIG. 5B. When infant care assembly 26 is not mounted on playyard 10, fabric bassinet 30 is flexible such that it can be folded up and, along with folded support frame 130 of changing platform 100, the combination in this folded condition (not shown) can be conveniently stored or transported. Support frame 130 also includes a connector ring 134 and pin 136 pivotably coupling support frame 130 to cross-bar 28, as suggested in FIGS. 1A-2B and best seen in FIGS. 5A-5B and 10-12.

As suggested in FIG. 5A, playyard 10 also includes a pair of coupling mechanisms 140. Each coupling mechanism 140 includes a first coupling or rail connector 104, shown as a J-shaped clip, and a second coupling or receiving area 138, shown, for example, as a portion of first end rail 20 having the smallest or least cross-sectional area or dimension along first end rail 20. Receiving area 138 is located between corner piece 38 and end rail locking mechanism 44. More specifically, for example, receiving area 138 is located between corner piece 38 and a connection point 142 of rail extender 21 to first end rail 20. The pair of J-shaped clips 104 each include an opening 144, as suggested in FIGS. 5A and 5B. Clips 104 are attached to fabric covering 102 and oriented and configured to couple to receiving areas 138 on frame 12 underlying fabric frame covering 14. When coupled, receiving areas 138 are partially encircled by and nest in clips 104. The coupling of clips 104 to receiving areas 138 places changing platform 100 in a use position, as suggested and shown in FIGS. 2A and 2B.

Figure 6:
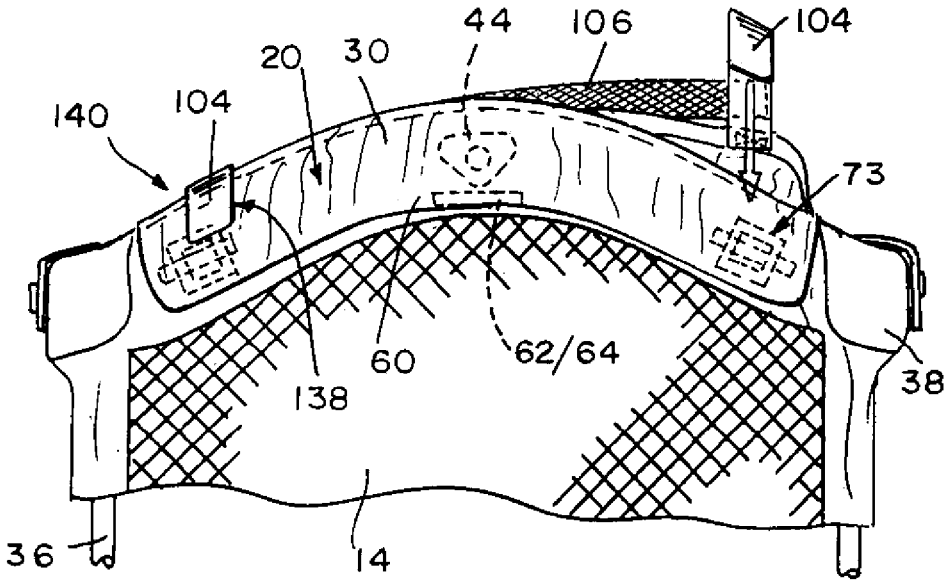
FIG. 6 is an end elevational view of the playyard of FIG. 2B, with portions broken away, showing one of the rail connectors coupled to the end rail of the frame and another rail connector positioned to be coupled to the end rail of the frame.
Figure 7:
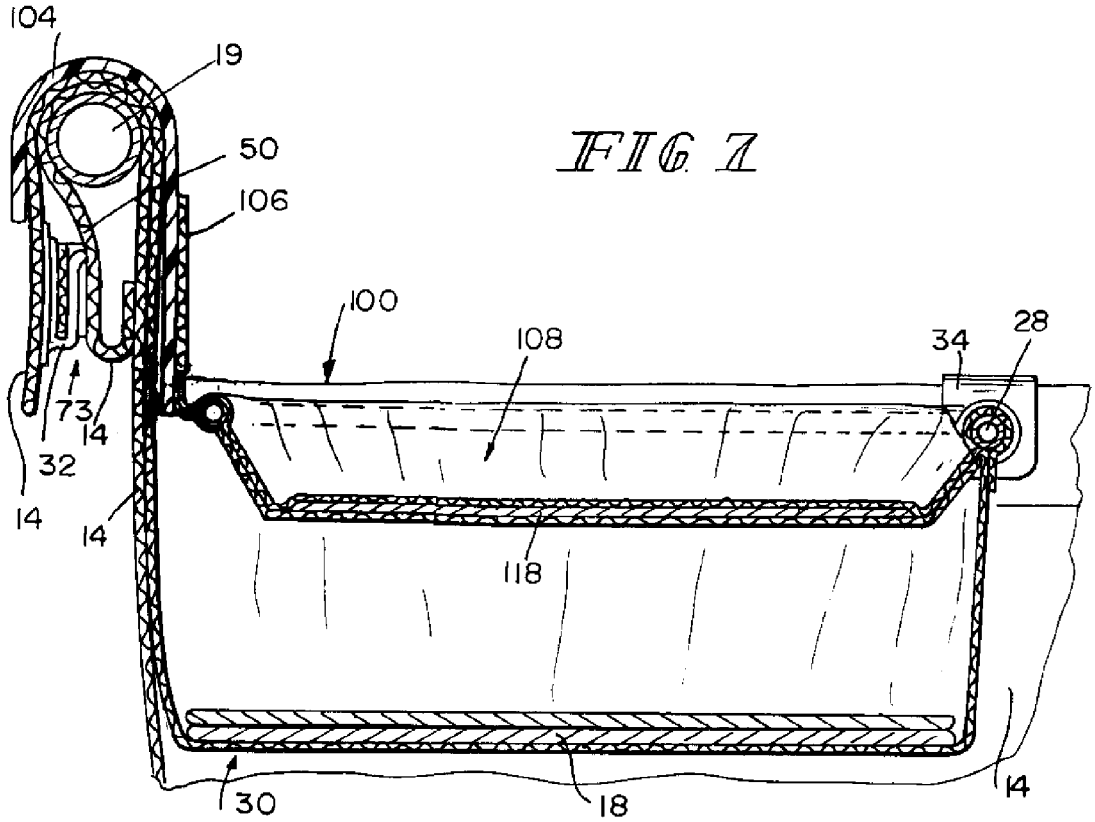
FIG. 7 is a substantially dead sectional view taken along line 7-7 of FIG. 2B showing the infant changing platform and fabric bassinet of the infant care assembly installed in their use positions in the playyard.

Fabric webbing 106 is attached to each clips 104 and essentially prevents a twisting of clips 104, thereby maintaining their orientation to couple changing platform 100 to, for example, first end rail 20. That coupling places changing platform 100 in the use position overlying fabric bassinet 30 in its own use position, as shown and suggested in FIGS. 6 and 7. It is within the scope of this disclosure for receiving areas 138 to be located elsewhere on first end rail 20 and/or to be configured differently. It is also within the scope of this disclosure for clips 104 to be configured differently to mate with receiving areas 138 and for there to be one or more clips 104.

Figure 8:
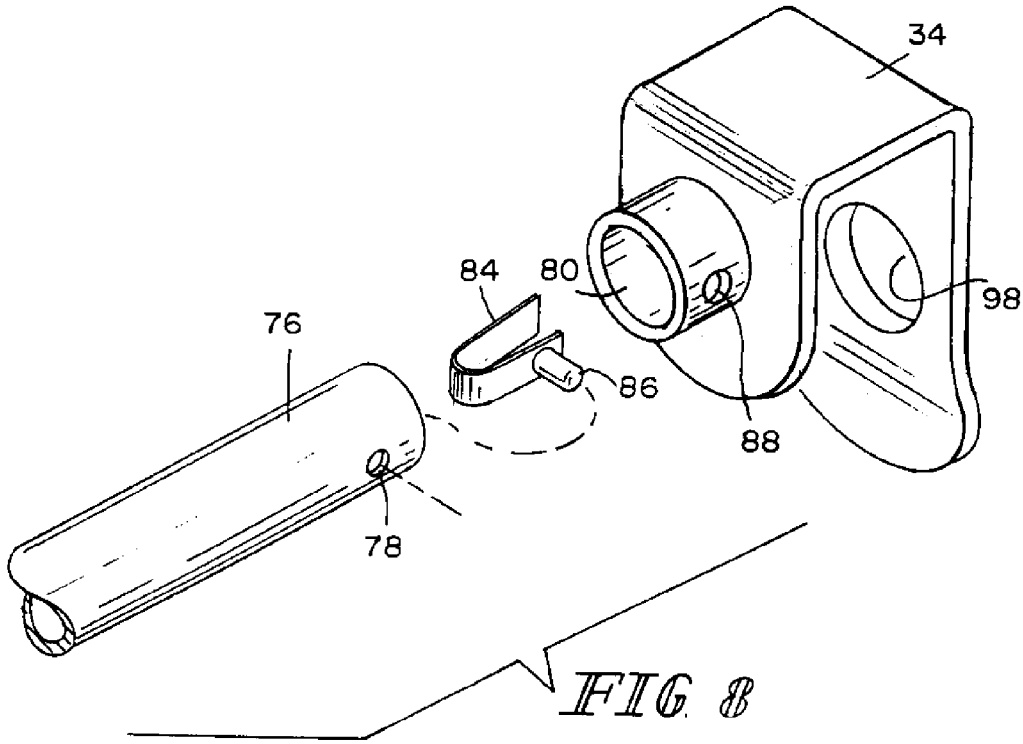
FIG. 8 is an enlarged, exploded perspective view of a portion of the cross-bar of FIG. 1A showing one of the frame connectors configured to be coupled to a rod of the cross-bar.

Cross-bar 28 includes rod 76, having an opening 78 at each end (only one end shown in FIG. 8), frame connectors 34, shown, for example, in FIG. 8 as J-shaped clips 34, each clip 34 includes a bushing 80 configured to receive an end of rod 76 in bushing opening 82, as suggested in FIG. 8. Cross-bar 28 also includes rod connector 84 having a protrusion or pin 86. Rod connector 84 is shown as a U-shaped spring-like element configured to be insertable inside rod 76 and to then have pin 86 protrude through opening 78 exterior to rod 76, as suggested in FIG. 8. Rod 76 is then insertable into bushing 80 compressing spring-like element 84 which then permits pin 86 to slide into bushing 80 and then snap through opening 88 on bushing 80, thereby connecting rod 76 to J-clip 34.

As noted above, infant care assembly 26 also includes frame connectors 34, shown, for example, as J-shaped clips (see FIGS. 1A, 1B, 8 and 10-12) and attached on each end of cross-bar 28. Each clip 34 includes an elongated side 92 having a through-opening 94 (see FIG. 8) configured to mate or couple to actuator or protruding element 48, as suggested in FIGS. 10-12. Each clip 34 also includes a free end or lip 96 configured to be manipulable by a person's finger in order to uncouple clip 34 from protruding element 48, as suggested in FIG. 12.

It is within the scope of the present disclosure that the receivers 50, 51 can be located on different and/or additional portions of fabric frame cover 14 overlying side rails 18, 19 and second end rail 22. Receiving areas 138 can be located on either end rail 20 or 22. That provides the option that fabric bassinet 30 is extendable toward and mountable, in its use position, on fabric frame cover 14 overlying either end rail 20 or 22 and that infant changing 100 is couplable in its use position to the same end rail 20 or 22 as fabric bassinet 30 in its use position. Similarly, clips 32 and 33 can be located on different portions of fabric bassinet 30 and clips 104 maybe located on different portions of changing platform 100 and/or additional or fewer clips 32, 33 and 104 can be used.

Turning now to the mounting of infant care assembly 26 to playyard 10, the coupling of the fabric bassinet 30 to fabric frame cover 14, and the coupling of changing platform 100 to frame 12. Clips 34 are constructed of a resiliently flexible material. When cross-bar 28 is to be mounted on frame 12, clips 34 are positioned over side rail locking mechanisms 40, 42 and clips 34 are lowered into position atop mechanisms 40, 42. A downward pressure, as suggested by arrow D in FIG. 10, on the clips 34 (only one clip 34 shown), which pressure can also be applied to cross-bar 28, results in through-openings 94 automatically snapping into place over protruding elements 48, as suggested in FIGS. 10 and 11, thereby removably securing cross-bar 28 to frame 12.

Fabric bassinet 30, hanging downwardly from cross-bar 28 is extendable toward first end rail 20 to be coupled to fabric frame cover 14. Bassinet clips 32 are coupled to respective receivers 50 by inserting clips 32 into loops 54 along side rails 18, 19 and first end rail 20 in an upward direction toward top opening 24 of the playyard 10, forming couplings 73, as suggested in FIG. 3A, and which couplings 73 are shown, for example, in FIGS. 7 and 9. Fabric cover clips 33 are coupled to respective receivers 51 by inserting clips 33 into loops 55 adjacent corner pieces 38 in a downward direction toward floor 25 forming coupling 75, as suggested in FIGS. 2A and 3B and shown in FIG. 3C. Securing mechanism 60 is also engaged by mating the hook 62 and loop 64 connectors, thereby providing an additional connection of fabric bassinet 30 to fabric frame cover 14 and allowing a portion of fabric bassinet 30 to cover actuator 48 of first end rail locking mechanism 44, as suggested in FIG. 4.

Couplings 73 are designed such that, if an upward force, as suggested by arrow F in FIG. 9, respectively, is exerted on fabric bassinet 30 from within top opening 24, a possible decoupling of the fabric bassinet 30 from fabric frame cover 14 is minimized or prevented because of a tensioning of couplings 73, as suggested by arrow T in FIG. 9. Each coupling 75, on the other hand, would essentially be twisted and/or tensioned by a downward force and an upward force from within top opening 24, as suggested by arrows $F_1$, $F_2$, $T_1$ and $T_2$ in FIG. 3C. The upward force $F_1$ will more likely cause a twisting of coupling 75, as suggested by arrows $T_1$ and $T_2$, as opposed to causing a straight raising of clip 33 to approach a decoupling of coupling 75. That is because clip 33 is rigid and loop 55 is flexible, and a movement of the fabric of fabric bassinet 30 around or adjacent clip 33 will contribute to the above-referenced twisting of coupling 75.

The amount of tensioning or twisting of couplings 75 may vary depending on the location within the top opening 24 from which the upward force F originates. Coupling 73 and 75 do cooperate to resist an uncoupling of the fabric bassinet 30 from the fabric frame cover 14 and possibly an uncoupling of changing platform 100 from frame 12 when upward force F is applied to the fabric bassinet 30 in the use position from within the top opening 24 (see FIG. 9). Particularly, for example, the proximity of couplings 75 to couplings 73 on first end rail 20 and couplings 73 on side rails 18, 19 that are closest to first end rail 20, is such that couplings 75 may function to lessen or diminish a tensioning of the just-mentioned couplings 73 when upward force F is applied to the fabric bassinet 30 in the use position from within the top opening 24. Such a lessening or diminishing effect may result from a limiting of the distance that portions of the fabric bassinet 30 may be moved when upward force F is applied. Despite this effect, the cooperation of couplings 73 and 75 still results in a resistance to or prevention of the uncoupling of the fabric bassinet 30 from fabric frame cover 14 and may result in a possible resistance to an uncoupling of changing platform 100 from frame 12 when upward force F is applied.

To uncouple changing platform 100 from frame 12 and return it to a non-use is stored position, clips 104 are uncoupled or lifted out of receiving areas 138 and changing platform 100 is rotated about cross-bar 28. To uncouple fabric bassinet 30 from frame 12, bassinet clips 32 are moved in a downward direction toward the floor 25 and removed from loops 54. Fabric cover clips 33 are moved in an upward direction toward top opening 24 and removed from loops 55. As suggested in FIG. 12, infant care assembly 26 is unmounted from playyard 10 in that frame connector 34 is uncoupled from protruding element 48 by moving free end or lip 96 a sufficient distance, in the direction of arrow A, for example, by a person's finger, to disengage through-opening 94 from protruding element 48. Cross-bar 28 may now be used to remove infant care assembly 26 from playyard 10.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A playyard comprising a frame including a fabric frame cover, two side rails and first and second end rails, the two side rails and the first and second end rails cooperating to form a top opening of the playyard, an infant care assembly mountable on the frame and including a cross-bar couplable to the playyard across the top opening at substantially a midpoint of each of the two side rails, a fabric bassinet coupled to the cross-bar and couplable to the fabric frame cover overlying the first end rail and the two side rails to place the fabric bassinet in a use position spanning across a portion of the top opening, and a changing platform coupled to and rotatable about the cross-bar, and a coupling mechanism configured to couple the changing platform to the frame in a use position overlying the fabric bassinet.

2. The playyard of claim 1, wherein the coupling mechanism includes a first coupling on the changing platform and a second coupling on the first end rail couplable to the first coupling.

3. The playyard of claim 2, wherein the second coupling is a receiving area on the first end rail, the receiving area being a portion of the first end rail having the smallest cross-section dimension along a length of the first end rail.

4. The playyard of claim 3, wherein the first coupling is a clip including an opening configured to couple to the receiving area.

5. The playyard of claim 4, wherein the first coupling is configured to couple only to the receiving area on the first end rail.

6. The playyard of claim 2, wherein the first coupling is configured to couple only to the first end rail.

7. The playyard of claim 3, further including a corner piece located at an intersection of one of the side rails and the first end rail and a first end rail locking mechanism located at essentially a mid-point of the first end rail, wherein the receiving area is located between an end of the first end rail locking mechanism and an end of the corner piece.

8. The playyard of claim 1, wherein the changing platform includes a pair of angled sides, a pair of angled ends and a bottom portion cooperating to form a recessed area on the changing platform to accommodate an infant.

9. The playyard of claim 8, wherein the bottom portion includes an opening configured to receive a rigid board to form a support in the recessed area for the infant.

10. The playyard of claim 1, wherein the coupling mechanism includes a pair of clips on the changing platform and a pair of receiving areas on the first end rail, each clip configured to be coupled to one of the receiving areas.

11. The playyard of claim 10, wherein the pair of clips is connected by a fabric webbing, the fabric webbing being attached to each clip and configured to prevent a twisting of each clip.

12. The playyard of claim 1, wherein the fabric bassinet is couplable to the second end rail in a use position instead of being couplable to the first end rail.

13. The playyard of claim 12, wherein the coupling mechanism is configured to couple the changing platform to the second end rail in a use position.

14. A playyard comprising a frame including two side rails and first and second end rails cooperating to form a top opening of the playyard, a bassinet assembly mountable on the frame across the top opening at substantially a midpoint of each of the two side rails, and including a fabric bassinet removably coupled to the two side rails and the first end rail in a use position spanning across a portion of the top opening, and a changing platform rotatably coupled at the midpoint to the bassinet assembly and removably mountable to the frame in a use position overlying the coupled fabric bassinet.

15. The playyard of claim 14, wherein the changing platform includes a first coupling and the frame includes a second coupling configured to couple to the first coupling to place the changing platform in a use position.

16. The playyard of claim 15, wherein the first coupling includes a pair of clips and the second coupling includes a pair of receiving areas on the first end rail.

17. The playyard of claim 16, wherein the pair of clips is connected by a fabric webbing, the fabric webbing being attached and configured to prevent a twisting of each clip to maintain each clip's orientation to be coupled to only the first end rail.

18. A playyard comprising a frame including a fabric frame cover, two side rails and first and second end rails, the two side rails and first and second end rails cooperating to form a top opening of the playyard, an infant care assembly mountable on the frame and including a cross-bar having frame connectors couplable to the frame across the top opening at substantially a midpoint of each of the two side rails, a fabric bassinet coupled to the cross-bar and couplable to the fabric frame cover on the first end rail and the two side rails to install the fabric bassinet in a use position spanning across a portion of the top opening, and a changing platform coupled to and rotatable about the cross-bar, and means for coupling the changing platform to the first end rail to place the changing platform in a use position overlying the installed fabric bassinet.

19. The playyard of claim 18, wherein the coupling means includes a first coupling on the changing platform and a second coupling on the first end rail, the first and second couplings configured to couple to each other.

20. The playyard of claim 19, wherein the first coupling includes a J-shaped clip and the second coupling includes a receiving area on the first end rail.

21. The playyard of claim 19, the first coupling includes a pair of clips connected to each other by fabric webbing, the fabric webbing is configured to prevent a twisting of the clips to maintain their orientation to be coupled only to the second end rail.

22. The playyard of claim 18, wherein the fabric bassinet is coupled to the fabric frame cover on the second end rail in a use position.

23. The playyard of claim 22, wherein the changing platform is couplable to the second end rail in a use position overlying the fabric bassinet in its use position instead of being couplable to the first end rail.

* * * * *